United States Patent [19]

Putti

[11] 4,330,242

[45] May 18, 1982

[54] MACHINE FOR EXTRUDING HOLLOW CORED CONCRETE SECTIONS

[76] Inventor: George Putti, 1336 Camridge Pl., West Vancouver, Canada

[21] Appl. No.: 222,090

[22] Filed: Jan. 2, 1981

Related U.S. Application Data

[63] Continuation of Ser. No. 33,751, Apr. 26, 1979, abandoned.

[30] Foreign Application Priority Data

May 3, 1978 [GB] United Kingdom ..... 7817394

[51] Int. Cl.[3] ..... B28B 21/08; B28B 21/14; B28B 21/42; B28B 21/52

[52] U.S. Cl. ..... 425/64; 425/224; 425/376 R; 425/432; 425/449; 425/580

[58] Field of Search ..... 425/64, 224, 432, 456, 425/580, 376, 449

[56] References Cited

U.S. PATENT DOCUMENTS

| | | | |
|---|---|---|---|
| 3,143,781 | 8/1964 | Kalns | 425/432 |
| 3,877,860 | 4/1975 | Putti | 425/432 |
| 3,989,230 | 11/1976 | Martens | 425/64 |
| 3,994,639 | 11/1976 | Hewitt | 425/432 |

*Primary Examiner*—Willard E. Hoag
*Attorney, Agent, or Firm*—Carver & Company

[57] ABSTRACT

A machine for extruding hollow cored concrete sections, wherein concrete forced into a travelling mold by augers and trailing mandrels form a cored concrete slab, wherein the mold is provided with a vibrating top plate assembly having forward and trailing sections, the forward section having a greater amplitude of vibration than the trailing section so as to minimize amplitude to vibration transferred to the concrete in the afterpart of the mold.

5 Claims, 2 Drawing Figures

MACHINE FOR EXTRUDING HOLLOW CORED CONCRETE SECTIONS

This is a continuation, of application Ser. No. 033,751, filed Apr. 26, 1979 and now abandoned.

BACKGROUND OF THE INVENTION

1. Field of the Invention

This invention relates to concrete extrusion machines for forming extrusions of concrete articles, such as floor slabs, panels and beams, and in particular to the production of cored slabs of concrete.

2. Prior Art

Conventionally, in extrusion machines for making cored concrete slabs, a travelling mold into which concrete is fed by a plurality of augers to which forming mandrels and finishing tubes are connected in a string, may use a vibrating plate spanning a moulding box which compacts the concrete slab as it is being formed and, due to vibrations imparted to the concrete, ease the passage of the mandrels and forming tubes through the concrete mass. Further, most such machines use a finishing plate following the vibrating plate which smoothes the top surface of the concrete and also use vibrators internally of the mandrel to further port the passage of the mandrel and finishing tubes through the concrete mass.

It has been found that, due to transmission of vibrations through the concrete mass, some settlement over the hollow cores takes place as the slab passes beneath the finishing plate so that the finished slab present a wavy upper surface.

Due to such settlement, the density of the concrete above each core is thus reduced. Also due to the friction of the finishing plate which retards movement of the extrusion machine when the slab is being formed, a certain amount of concrete will back-feed by the augers.

SUMMARY OF THE INVENTION

The present invention provides an extrusion machine of the above type in which the vibrating plate or plates and the vibrators are arranged and constructed so as to provide vibrations of decreasing amplitude from the mandrel rearwardly over the forming tubes. In one embodiment of the invention, two vibrators and vibrating plates are used in tandem with the second vibrator providing vibrations of lesser amplitude than the first vibrator. In another embodiment of the invention, one vibrating plate is used, however, it is so arranged that the leading portion of the plate over the auger and mandrel has a greater amplitude of vibration than the trailing portion of the plate which extends over the forming tubes.

A detailed description following, related to the drawings, gives exemplification of apparatus according to the invention which, however, is capable of expression in means other than those particularly described and illustrated.

DETAILED DESCRIPTION

Figures 1, 2, 3, 4:
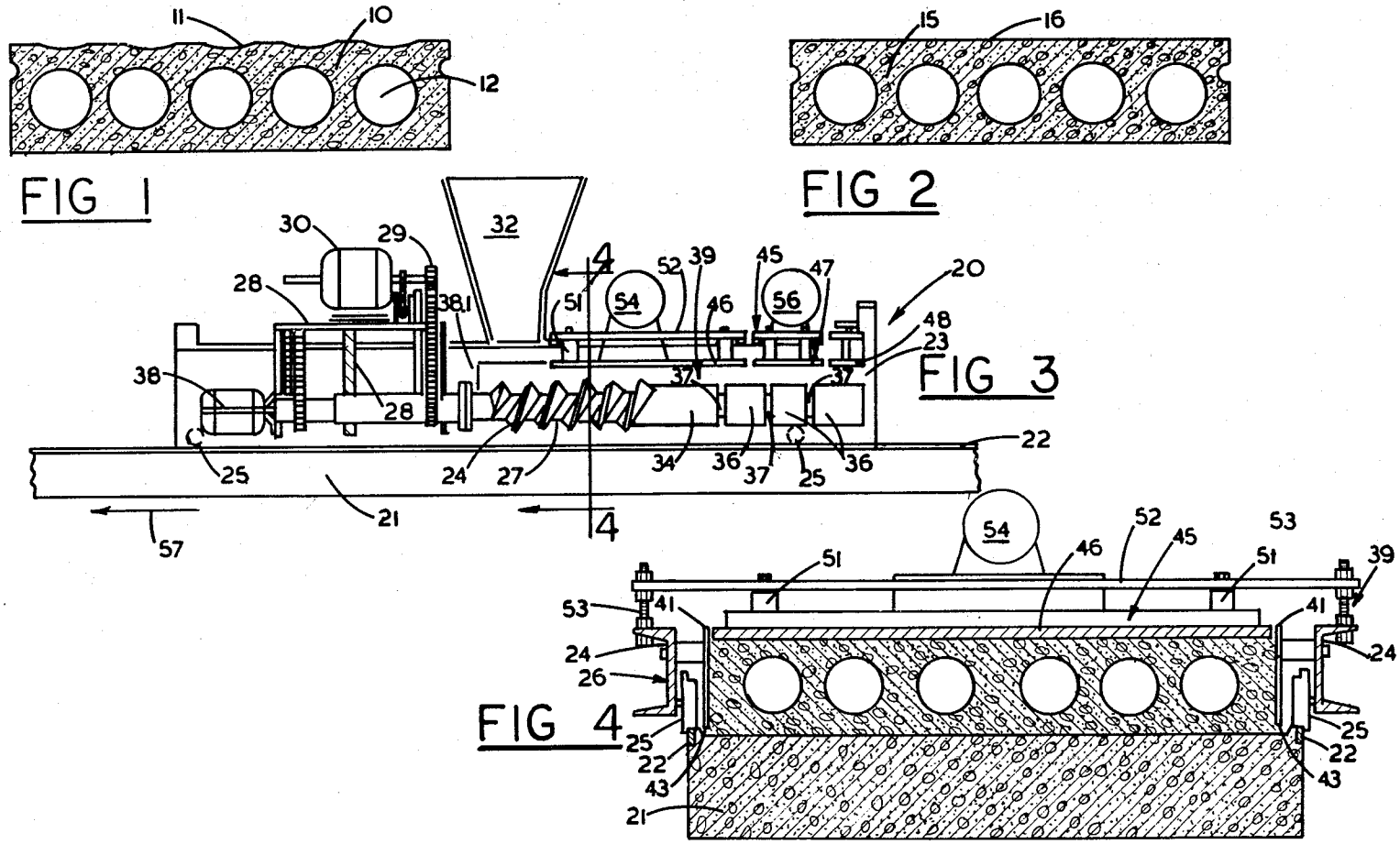
FIG. 1 is a transverse section of a cored slab formed with use of the prior art extrusion machines.
FIG. 2 is a transverse section of a slab formed with use of the extrusion machine of the present invention.
FIG. 3 is a partially schematic elevation of one embodiment of the machine for forming hollow cored concrete sections.
FIG. 4 is a section taken on line 4—4 of FIG. 3.

Referring to the drawings, particularly FIGS. 1 and 2 thereof, FIG. 1 shows a typical finished cored concrete slab 10 produced by conventional prior art extruders showing the typical wavy surface 11 provided slump of the concrete over the cores 12. FIG. 2 shows a slab 15 provided by the extrusion machine of the present invention exemplifying the straight, level, finished surface 16 desired.

Referring particularly to FIG. 3, and also with reference to FIG. 4, one embodiment 20 of an extrusion machine in accordance with the invention is shown. This machine is adapted to travel over a stationary casting bed and form 21 which has a pair of parallel rails 22 and to extrude thereon the cored slab 15. The machine is constructed in a manner similar to the machine described and illustrated in my Canadian Pat. No. 910,030 and has a main frame 23 comprised of transverse and longitudinal frame members, the longitudinal frame members 24 only being shown. Flanged wheels 25 mounted on the longitudinal frame members support and guide the machine on the rails for movement longitudinally of the casting bed.

The machine has a plurality of longitudinally extending augers 27 mounted for rotation in a supporting framework 28 supported by the main frame. The augers, one only of which is shown, extend in parallelism one for each core in the slab to be poured. These augers are driven via a roller chain train 29 by an electric motor 30 mounted on the supporting framework 28 and extend beneath a hopper 32 which is adapted to receive and discharge on the augers a premixed concrete of desired consistency. A mandrel 34 is connected to and forms part of the aft end of the augers and forming tubes 36 are connected in tandem to the aft end of the mandrel. The forming tubes are separated from each other and from the mandrel by vibration dampening blocks 37 which can be formed of a resilient material, such as rubber. Each of the augers, as described in my Canadian Pat. No. 910,030, is hollow and houses vibrator mechanism, not shown, operated by electric motors 38. The vibrating mechanism also extends into the mandrels.

The augers extend through a feed chamber 38.1 and together with the mandrel and the forming tubes, extend into a mold 39 into and through which concrete delivered into the feed chamber through the hopper, is forced by the augers.

The mold is formed of a pair of vertical side plates 41 secured by bolts 42 to the longitudinal frame members and which extend the full length of the augers and mandrels and forming tubes. Lower edges 43 of the side plates are just clear of the casting bed and serve to restrict lateral displacement of the concrete moved into the mold.

The mold also has a longitudinally sectionalized top plate structure 45 which consists of a pair of vibratory plates 46 and 47 disposed in tandem and followed by a finishing plate 48. Vibratory plate 40 is rectangular in plan and is supported by bolts and vibratory dampening blocks 51 from a cross frame structure 52, the latter being adjustably mounted on the longitudinal main frame members by bolts 53. Vibratory plate 46, it is seen, extends over the auger and mandrel and has a mechanical vibrator 54 mounted centrally thereon. Vibratory plate 47, which also has a vibrator 56 mounted thereon, is mounted on the machine in the manner as described with reference to the vibratory plate 46. Finishing plate 48 is simply a smooth transversely extending plate mounted in the manner as described with reference to the vibratory plates over and following the last forming tubes. Vibratory plate 46 is set a little above, approximately ⅛ inches, the elevation of the desired finished surface of the concrete slab and vibratory plate 47 is set at the same elevation as the finished surface, as is the finishing plate 48. Furthermore, the vibrators 54 and 56 are chosen and arranged so that the amplitude of vibration of vibratory plate 46 is far in excess of the amplitude of vibration of the plate 47. In effect the plate 46 is a lead section of top plate structure 45 disposed over the auger and mandrel, and the plate 47 is a trailing section of the top plate structure disposed over the forming tubes. In operation, the machine automatically moves forward in the direction shown by arrow 57 under the pressure of the augers against the formed concrete in the mold, passage of the concrete through the mold being eased by the vibrations set up by the internal vibrators and the vibratory plates 46 and 47. Vibrations set up by the internal mandrel vibrator and the vibratory plate 46 normally would result in settlement of the slab over the finished cores as the last trailing forming tube leave the empty core. However, these large amplitude vibrations are interfered with by the vibrations set up by the vibratory plate 47 which not only further compact the slab, but serves to dampen the effect of the vibrations of the mandrel vibrator and vibratory plate 46 so as to reduce, substantially, settling or sagging of the concrete as the finishing plate passes thereover.

Figure 5:
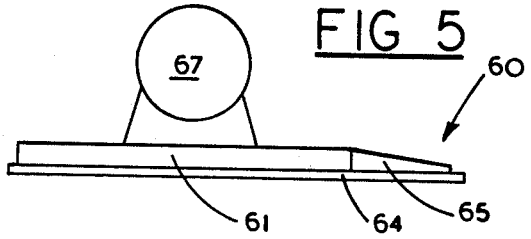
FIG. 5 is a side elevation showing a vibratory plate of another embodiment of the invention.
Figure 6:
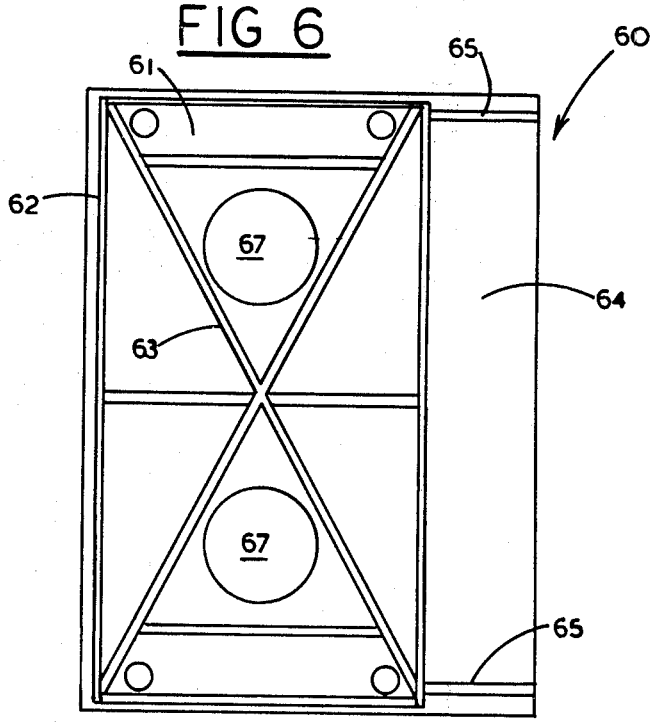
FIG. 6 is a plan view of the vibratory plate shown in FIG. 5.

FIGS. 5 and 6 show an alternate form of vibratory plate apparatus 60 which can be used in place of the vibratory plates 46 and 47. Vibratory plate apparatus 60 which, although being a single plate the length of which is substantially the same as the combined length of vibratory plates 46 and 47, is in fact longitudinally sectionalized. Vibratory plate 60 has a lead section 61 provided with peripheral bracing 62 and cross bracing 63, so as to obtain substantial rigidity. The lead section terminates in a trailing section 64 which has light side braces 65. The plate structure 60 is supported from the supporting cross frame 52 by bolts and vibration dampers, similar to the bolts and vibration dampers 51, which are connected to plate 60 at the four corners of the lead section 61 so that, in fact, the trailing section is cantilevered. Vibratory plate apparatus 60, like vibratory plates 46 and 47, has a mechanical vibrator 67 mounted centrally of the lead section 61. Further, lengths of the lead and trailing sections are such that the lead section will extend over the auger and mandrel with the trailing section extending over the trailing forming tubes.

In operation of vibratory plate structure 60, amplitude of vibration in the trailing section 64 will be less than the amplitude of vibrations in the lead section 52 and, consequently, will interfere and dampen vibrations in the concrete slab set up by the internal mandrel vibrators and the lead section and thus will have the same effect as the two plate arrangement of embodiment 20.

I claim:

1. In a traveling machine for forming hollow cored concrete sections on a base which has a wheeled frame arranged for travel longitudinally of the base, a feed chamber having a hopper for enabling discharge of premixed concrete onto the base, a molding chamber following the feed chamber and at least one auger assembly extending through the feed chamber and molding chamber for moving the concrete into the molding chamber, wherein:

(a) the auger assembly includes an auger, a mandrel cooperating with and following the auger, vibrating means for imparting vibrations to the auger and mandrel, and a forming tube following and connected to the mandrel, the following tube being connected to the mandrel by vibration dampening means which attenuates vibrations transmitted from the mandrel, (b) the molding chamber includes a pair of vertically disposed and longitudinally extending side plates mounted on the frame on opposite sides of the auger assembly for restraining lateral movement of the concrete, (c) a longitudinally sectionalized top plate structure extends between the side plates and has:

(i) a lead section directly disposed over the auger and mandrel to provide vibrations of relatively large amplitude, (ii) a trailing section directly disposed over the forming tube to provide vibrations of substantially smaller amplitude than those applied by the lead section, (iii) vibrating means mounted on the top plate structure for vibrating the latter and arranged to provide vibrations of a greater amplitude to the lead section than to the trailing section, whereby a greater amplitude of vibration is imparted to the concrete at the lead section of the top plate structure adjacent the mandrel than at the trailing section of the top plate structure adjacent the forming tube, the vibrations from the auger assembly being interfered with by the vibrations set up by the trailing section of the top plate to compact the concrete.

2. In the traveling machine for forming hollow cored concrete sections as set forth in claim 1, wherein:

(a) the top plate structure has two plates arranged in tandem with each plate having a separate vibrator mounted thereon.

3. The traveling machine for forming hollow cored concrete sections as set forth in claim 1, wherein:

(a) the top plate structure comprises a single plate having a rigidly braced rectangular lead section and an integrally connected trailing section disposed behind said lead section with support means at the lead section for mounting the lead section on the frame.

4. The traveling machine for forming hollow cored concrete sections as set forth in claims 2, 3 or 1, wherein:

(a) vibration means is directly associate with the auger and mandrel for imparting vibration thereto.

5. The traveling machine for forming hollow cored concrete sections as set forth in claims 2, 3 or 1, wherein:

(a) the top plate structure is clear of the side plates and includes vibration dampening means disposed between the frame and of the top plate structure for inhibiting transmission of vibrations from the top plate structure to the frame.

* * * * *